US011982468B2

(12) United States Patent
Traeger

(10) Patent No.: US 11,982,468 B2
(45) Date of Patent: May 14, 2024

(54) OUTDOOR HEATING DEVICES AND METHODS OF USE

(71) Applicant: Tyson Traeger, Mt Angel, OR (US)

(72) Inventor: Tyson Traeger, Mt Angel, OR (US)

( * ) Notice: Subject to any disclaimer, the term of this patent is extended or adjusted under 35 U.S.C. 154(b) by 470 days.

(21) Appl. No.: 17/368,659

(22) Filed: Jul. 6, 2021

(65) Prior Publication Data

US 2023/0010058 A1 Jan. 12, 2023

(51) Int. Cl.

| | |
|---|---|
| ***F23N 1/00*** | (2006.01) |
| ***F23N 1/04*** | (2006.01) |
| ***F24B 13/04*** | (2006.01) |
| ***F24H 3/00*** | (2022.01) |
| ***F24H 9/02*** | (2006.01) |
| ***F24H 9/06*** | (2006.01) |

(52) U.S. Cl.

CPC ..... *F24H 3/008* (2013.01); *F23N 1/007* (2013.01); *F23N 1/047* (2013.01); *F24B 13/04* (2013.01); *F24H 9/02* (2013.01); *F24H 9/06* (2013.01); *F23N 2225/13* (2020.01)

(58) Field of Classification Search

CPC ... F24H 3/008; F24H 9/02; F24H 9/06; F23N 1/007; F23N 1/047; F23N 2225/13; F24B 13/04; F23B 40/08; F23B 50/12; F23B 2900/00001; F23K 3/22

USPC ..... 126/107, 501, 10, 68, 73, 25 A, 145

See application file for complete search history.

(56) References Cited

U.S. PATENT DOCUMENTS

| | | | | | |
|---|---|---|---|---|---|
| 79,696 | A | * | 7/1868 | Spear | F24B 1/024 126/144 |
| 89,180 | A | * | 4/1869 | Spear | F24B 5/04 126/68 |
| RE4,985 | E | * | 7/1872 | Spear | 126/68 |
| RE4,986 | E | * | 7/1872 | Spear | 126/68 |
| 129,348 | A | * | 7/1872 | Keep | F24B 5/04 126/144 |
| 486,067 | A | * | 11/1892 | Allan | F23B 5/00 126/145 |
| 1,200,261 | A | * | 10/1916 | Stockstrom | F23D 3/00 431/197 |
| 2,186,581 | A | * | 1/1940 | Ganner | F23L 15/04 110/297 |
| 2,425,036 | A | * | 8/1947 | Howe | 126/30 |
| 2,455,154 | A | * | 11/1948 | Bailey | A47B 96/16 312/307 |

(Continued)

FOREIGN PATENT DOCUMENTS

| | | | | | |
|---|---|---|---|---|---|
| CN | 105387452 | A | * | 3/2016 | F23K 1/025 |
| CN | 108180505 | A | * | 6/2018 | F24B 1/028 |

(Continued)

*Primary Examiner* — Avinash A Savani

(74) *Attorney, Agent, or Firm* — Baumgartner Patent Law; Marc Baumgartner

(57) ABSTRACT

Devices and methods for outdoor heating. A stove device includes a fuel system attached to a combustion chamber to deliver fuel from a hopper of the fuel system to the combustion chamber for combustion in a firepot assembly positioned inside the combustion chamber. A distance between a chute of the fuel system and the firepot assembly is adjustable to change an amount of fuel for combustion and thereby control temperature of combustion. The distance may be decreased to decrease the temperature and may be increased to increase the temperature.

18 Claims, 16 Drawing Sheets

(56) References Cited

U.S. PATENT DOCUMENTS

| | | | | | |
|---|---|---|---|---|---|
| 4,281,633 | A * | 8/1981 | Wackerman | A47J 37/0704 | 126/25 C |
| 5,154,159 | A * | 10/1992 | Knafelc | A47J 37/0704 | 126/25 B |
| 10,436,439 | B1 * | 10/2019 | Traeger | F23B 40/00 | |
| 2004/0154603 | A1 * | 8/2004 | Crawford | A47J 37/079 | 126/25 B |
| 2006/0096585 | A1 * | 5/2006 | Dahl | A47J 37/0731 | 126/42 |

FOREIGN PATENT DOCUMENTS

| | | | | |
|---|---|---|---|---|
| CN | 111189066 | A * | 5/2020 | F24B 1/16 |
| CN | 111998393 | A * | 11/2020 | F24B 13/04 |
| GB | 2059572 | A * | 4/1981 | F24B 1/024 |
| KR | 101249776 | B1 * | 7/2012 | F24B 1/08 |

* cited by examiner

OUTDOOR HEATING DEVICES AND METHODS OF USE

STATEMENT REGARDING FEDERALLY SPONSORED RESEARCH OR DEVELOPMENT

None.

CROSS-REFERENCE TO RELATED APPLICATIONS

None.

FIELD

The disclosure relates to devices and systems for outdoor heating. A stove device includes a fuel system for storing and controllably delivering fuel to a firepot inside a combustion chamber. A distance between the firepot and the fuel system is adjustable to change an amount of fuel for combustion and thereby control temperature of combustion.

BACKGROUND

Many individuals use outdoor heating in a variety of settings, such as dining out, social gatherings, sporting events, and the like. Typical outdoor heating devices use gas or propane. Gas or propane-fueled outdoor heating devices enable users to conveniently control temperature, for example by increasing and decreasing the amount of gas or propane delivered to the flame, but these approaches generally do not provide sufficient radiant heat to their surroundings. As a result, individuals are often not sufficiently warmed by gas and propane-fueled outdoor heating solutions. Alternative approaches include wood and wood pellet heating devices. These devices can, in certain circumstances, provide sufficient heat to their surroundings, but generally do not provide convenient control of temperature.

Accordingly, there is a need for improved devices and systems for outdoor heating which provide sufficient radiant heat to their surroundings, and which also provide convenient control of temperature. The present disclosure addresses this unmet need.

SUMMARY

The disclosure relates to improved outdoor heating devices that utilize wood or wood pellets to provide sufficient radiant heat to their surroundings and which also utilize innovative mechanical features to enable individuals to conveniently adjust temperature of combustion. A stove device includes a firepot assembly, positioned in a combustion chamber of a housing of the stove device and configured for combustion of a fuel thereon, which is variably distanced from a fuel system configured to store the fuel and deliver the fuel to the firepot assembly for combustion. During use of the stove device, a distance between the firepot assembly and the fuel system can be adjusted to control temperature of combustion.

The housing can be comprised of a wheeled base affixed to a plurality of walls to form the combustion chamber and can include a roof with an exhaust assembly that extends upward therefrom as well as an ash tray disposed below the firepot assembly. The housing can be attached to a fuel system that comprises a hopper and a chute that can be used to gravity feed the fuel from the hopper through the chute and to the firepot assembly during combustion of the fuel.

Heated air and gaseous combustion byproducts are directed upward through the exhaust assembly to a radiant cap at an upper portion of the elongated tube. Heat that reaches the radiant cap is radiated therefrom toward an area around the stove device to warm the area.

During combustion, the fuel can be held by the firepot assembly. As solid combustion byproducts accumulate, they can fall from the firepot assembly toward the ash tray or can accumulate on bars of a firepot of the firepot assembly. If the solid combustion byproducts build up at the firepot, this can impede the combustion reaction and can necessitate manual removal of the solid combustion byproducts by a sweep having brushes that are slidably disposed between bars of the firepot. A slide movement of the sweep moves brushes of the sweep to remove the solid combustion byproducts from the bars of the firepot which then fall from the firepot assembly toward the ash tray to facilitate combustion.

Temperature of combustion can be controlled by any of a plurality of mechanisms, including but not necessarily limited to a vertical or a horizontal adjustment of a handle member affixed to the firepot assembly. The handle member can be affixed to the firepot, the sweep, or a wedge. If the handle member is affixed to the firepot or the sweep, then a portion of the firepot can be moved vertically to adjust the distance between the firepot and the fuel system and secured at a desired position with a securement mechanism. If the handle member is affixed to the wedge, then the wedge can be moved horizontally to slide the wedge in and out from under a ridge of the firepot to vertically move a portion of the firepot to adjust the distance between the firepot and the fuel system which can be secured at a desired position with a securement mechanism.

An object of the present disclosure is to provide improved devices and systems for outdoor heating that provide sufficient and adjustable heat which can be made and used according to suitable manufacturing processes.

Other objects, features and advantages of the present disclosure will become apparent from the following detailed description taken in conjunction with the accompanying drawings.

BRIEF DESCRIPTION OF THE DRAWINGS

Although the characteristic features of the invention will be particularly pointed out in the claims, exemplary implementations of the invention and manners in which they can be made and used can be better understood after a review of the following description, taken in connection with the accompanying drawings, wherein like numeral annotations are provided throughout.

DETAILED DESCRIPTION

Figure 1A:
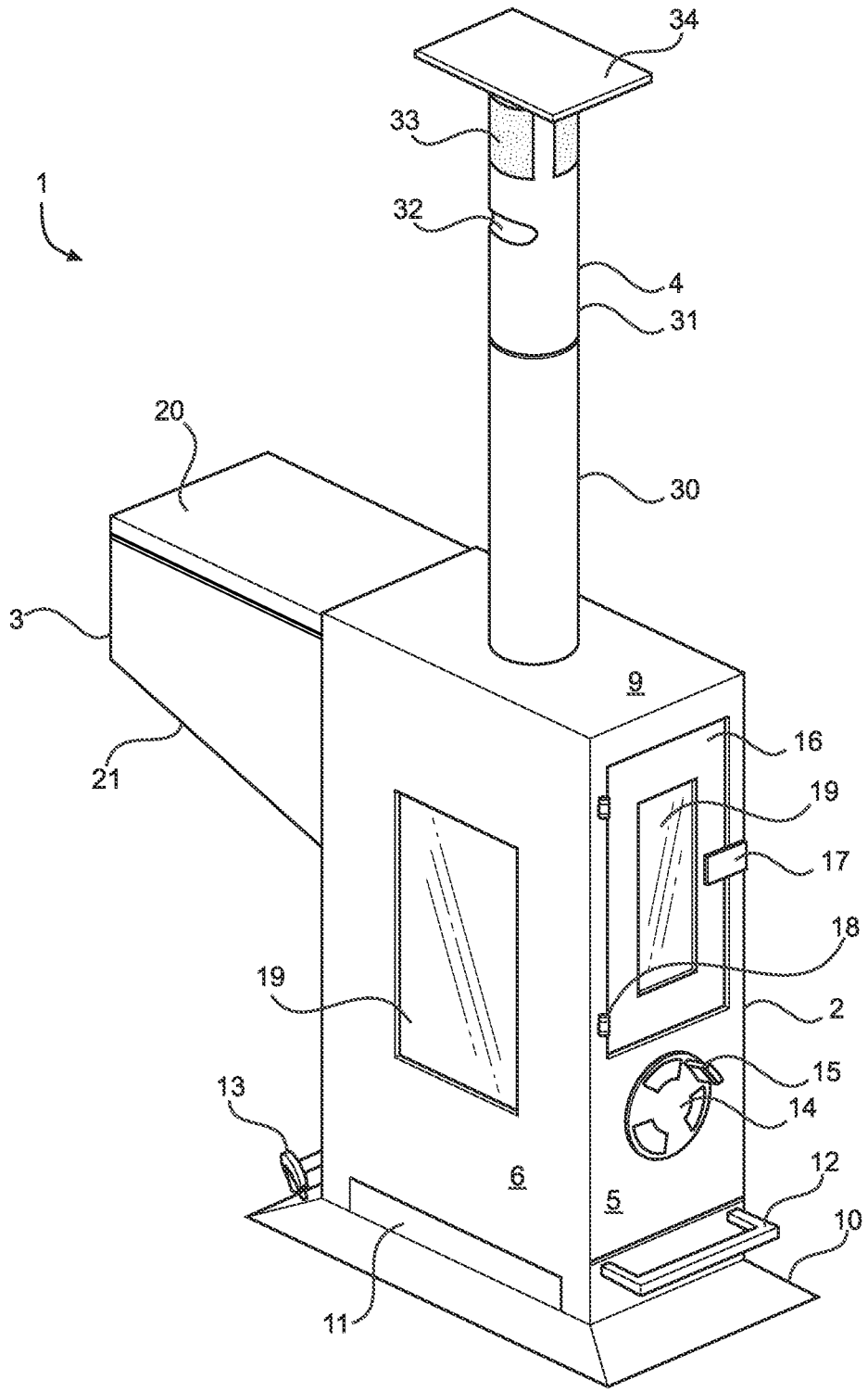
FIG. 1A depicts a front perspective view of a stove device for outdoor heating.

Reference is made herein to the attached drawings. Like reference numerals can be used in the drawings to indicate like or similar elements of the description. The figures are intended for representative purposes, are not drawn to scale, and should not be considered limiting.

Unless otherwise defined herein, terms and phrases used in connection with the present disclosure shall have the meanings that are commonly understood by those of ordinary skill in the art.

As used in the description and in the claims, the terms "comprising" and "comprises" do not exclude other elements or steps. Where an indefinite or definite article is used when referring to a singular noun, e.g., "a," "an," or "the," this includes a plural of that noun unless something else is specifically stated. Furthermore, the terms first, second, third, and the like in the description and in the claims, are used for distinguishing between elements and not necessarily for describing a sequential or chronological order. It is to be understood that the terms so used are interchangeable under appropriate circumstances and that the implementations of the disclosure described herein are capable of operation in other sequences than described or illustrated herein.

As used herein, the terms "about" and "substantially so" refer to the usual error range for the respective value readily known to the skilled person in this technical field. Reference to "about" or "substantially so" with respect to a value or parameter herein includes and describes implementations that are directed to that value or parameter per se.

Figure 1B:
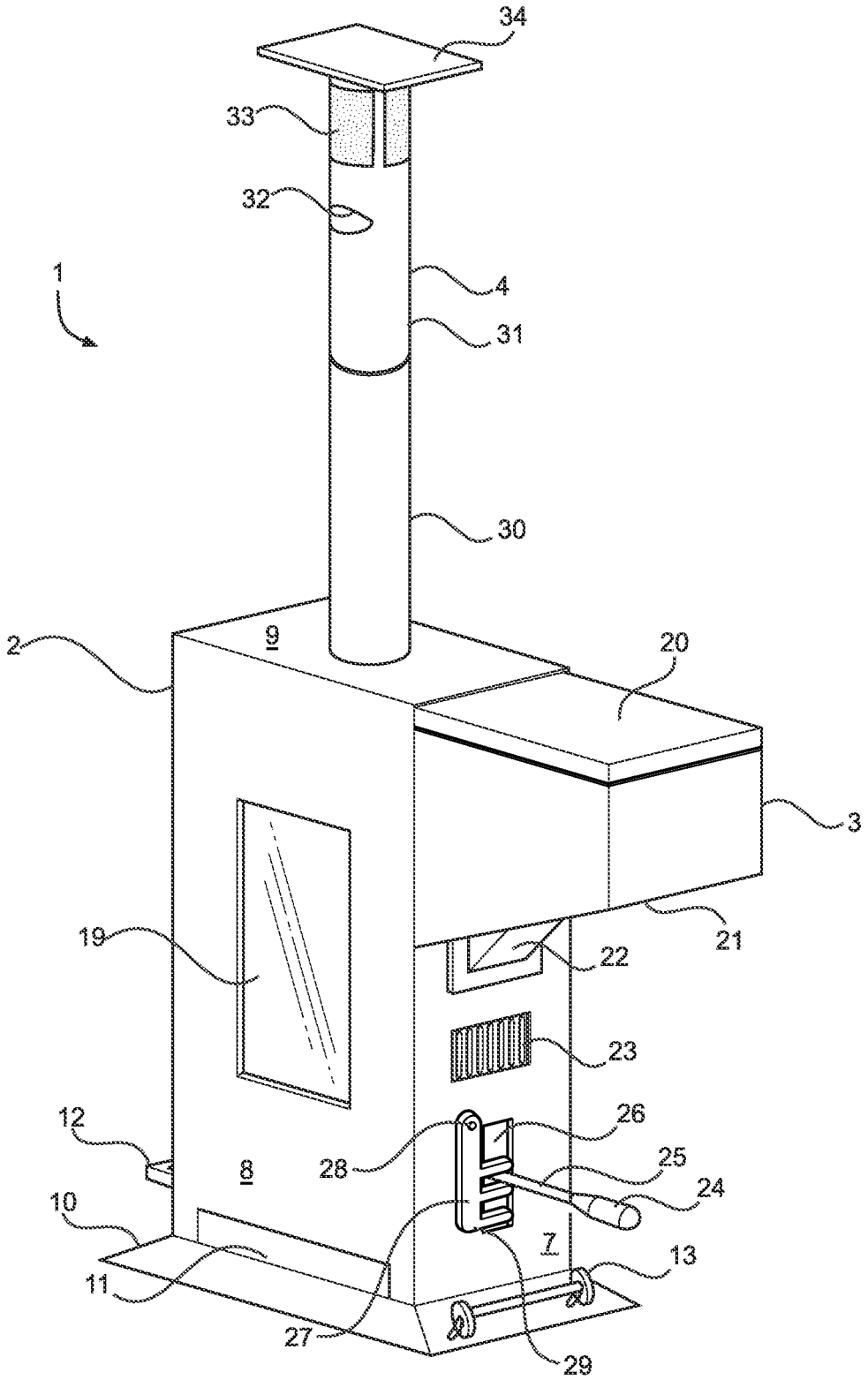
FIG. 1B depicts a back perspective view of a stove device for outdoor heating.

Referring now to FIGS. 1A, and 1B, there are depicted a front perspective view (FIG. 1A) and a back perspective view (FIG. 1B) of a stove device for outdoor heating. Generally, a stove device 1 comprises a housing 2 comprising a combustion chamber with a firepot assembly configured for combustion of a fuel thereon positioned inside the combustion chamber, and a fuel system 3 configured to store the fuel and deliver the fuel to the firepot assembly for combustion. The stove device 1 can also comprise an exhaust assembly 4 affixed to the housing 2 to operably connect the combustion chamber to an exterior of the stove device 1.

The housing 2 can be comprised of a wheeled base 10 which engages a surface thereunder either with a base of the wheeled base 10 or with a wheel assembly 13 attached to the base which can benefit moving the stove device 1 from one location to another. The wheeled base 10 can be affixed to a plurality of walls, such as front wall 5, right wall 6, back wall 7, and left wall 8. Walls of the plurality of walls can extend upward from the wheeled base 10 and connect to each other to form the combustion chamber. The housing 2 can comprise a roof 9 which connects to walls of the plurality of walls (such as front wall 5, right wall 6, back wall 7, and left wall 8) to define a volume of the combustion chamber. The roof 9 can be connected to the exhaust assembly 4 which extends upward from the roof 9 to expel gaseous combustion byproducts therefrom.

The exhaust assembly 4 can be comprised of a lower tube 30 connected to an upper tube 31 to form an elongated tube (30, 31) which can be hollow to allow heat and gaseous combustion byproducts to pass from the combustion chamber upward therethrough to a vent 32, a spark arrestor 33, and a radiant cap 34 disposed at an upper portion of the elongated tube (30, 31). The gaseous combustion byproducts can be expelled through the vent 32 and sparks can be stopped from exiting the elongated tube (30, 31) by the spark arrestor 33. Hot gases and radiation contact the radiant cap 34 which becomes heated and radiates heat to an area around the stove device 1.

The fuel system 3 can be comprised of a hopper 20 which can comprise a lid thereon configured to open and close to enable an individual to add (and potentially remove) fuel to and from an interior of the hopper 20. A hopper bottom 21 can be suitably angled to direct fuel from the interior of the hopper down a chute 22 of the fuel system 3 and into the combustion chamber and the firepot for combustion. The fuel system 3 can be assembled and attached to the housing 2 during assembly of the stove device 1.

The plurality of walls (such as front wall 5, right wall 6, back wall 7, and left wall 8) can comprise windowpanes 19 to enable individuals to view the combustion chamber from outside the stove device 1 before, during, and after use of the stove device 1. The front wall 5 can comprise a door 16 with hinges 18 and a latch 17 to configure the door 16 to open and close to enable an individual to perform maintenance on the stove device 1. The front wall 5 can comprise an air flow vent 14 that is, for example, rotatably adjustable by a handle 15 such that an air flow from an exterior of the stove device 1 is adjusted to control oxygen availability and combustion efficiency and temperature. An ash tray 11, the sides of which are visible in the figures, comprises an ash tray base affixed to a plurality of ash tray walls to define an ash tray volume that is suited to hold solid combustion byproducts therein. A handle 12 can be disposed on a front surface of the ash tray 11 to enable an individual to slidably remove the ash tray 11 from the housing 2 for maintenance and removal of ashes.

A rear vent 23 can be positioned on the back wall 7 to operably connect the combustion chamber to the exterior of the stove device 1 to provide a certain rate of air flow to the combustion chamber. The back wall 7 can comprise a handle aperture 26 through which a handle member having a handle 24 connected to the firepot assembly by a rod 25 can be gripped and adjusted to adjust a position of the firepot assembly relative to the fuel system 3 or a component thereof (such as the chute 22 of the fuel system 3). If the handle 24 undergoes a vertical adjustment to raise or lower the firepot assembly to a desired position, then the handle 24 and rod 25 can be secured at the desired position with a securement mechanism such as a securement member 27.

The securement member 27 can be pivotally attached to the back wall 7 by a fastener 28 such that members 29 can be swung outward (i.e., toward the left wall 8) to allow the handle 24 and the rod 25 to be vertically adjusted, and swung inward (i.e., toward the right wall 6) such that the rod 25 rests upon a member 29 of a plurality of members 29 to secure the vertical position of the handle 24 and the rod 25, and thereby the firepot, relative to the fuel system 3 and thereby select a desired heat output from the stove device 1. The notched member 27 is shown as pivotally attached to a left portion of the back wall 7 but can be pivotally attached to a right portion of the back wall 7. The notched member 27 is exemplary and alternate securement mechanisms can be used to secure the firepot assembly without departing from the scope of the disclosure. While FIGS. 1A and 1B depict three levels for incremental height adjustment, any suitable number of levels for incremental height adjustment can be used with the teachings herein, such as 2-6 levels, for example. In addition to or alternative to incremental height adjustment of the firepot, continuous height adjustment of the firepot can be implemented, such as through the use of one or more wedges, as discussed below.

Figure 2A:
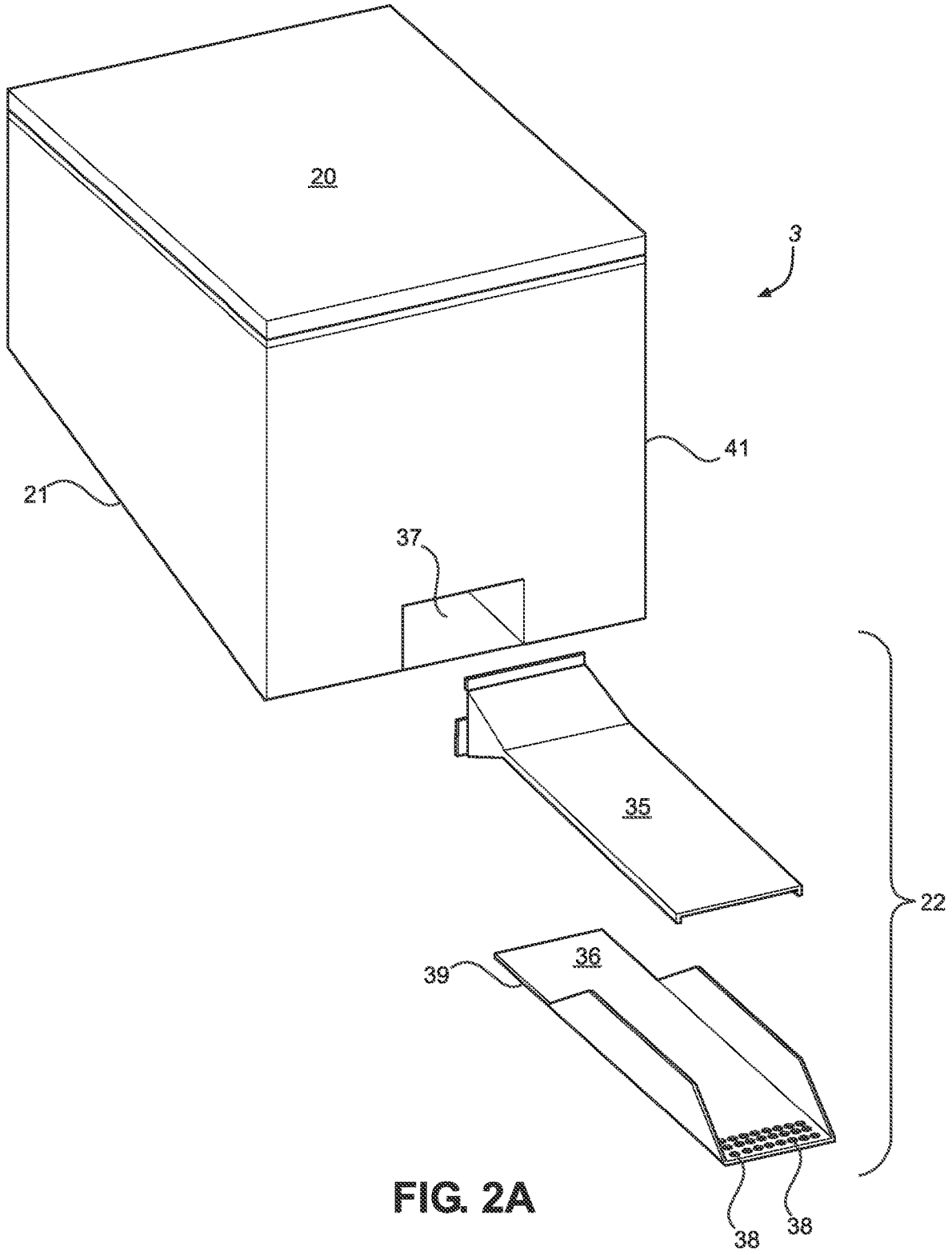
FIG. 2A depicts a perspective view of a fuel system, disassembled.
Figure 2B:
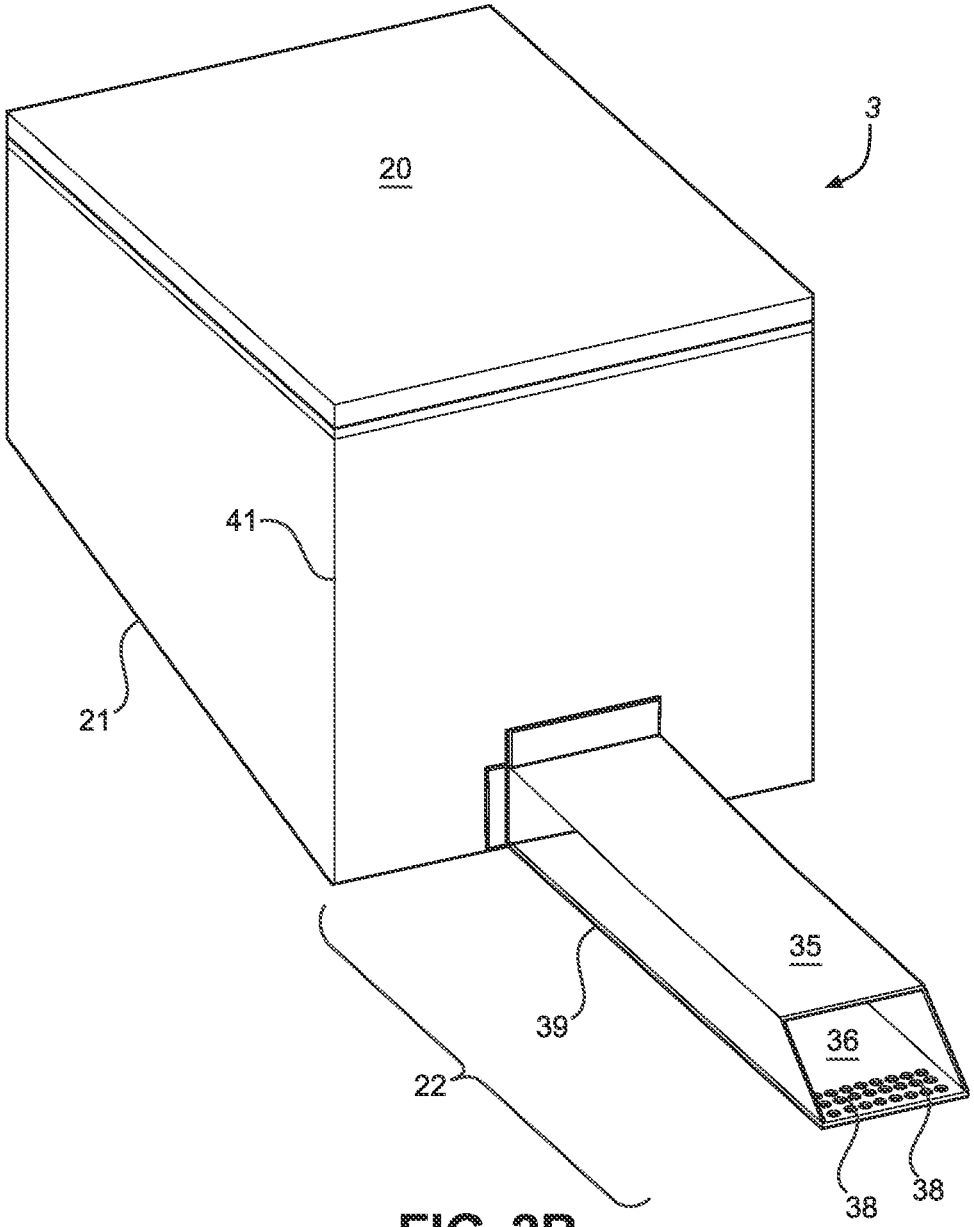
FIG. 2B depicts a perspective view of the fuel system, assembled.
Figure 2C:
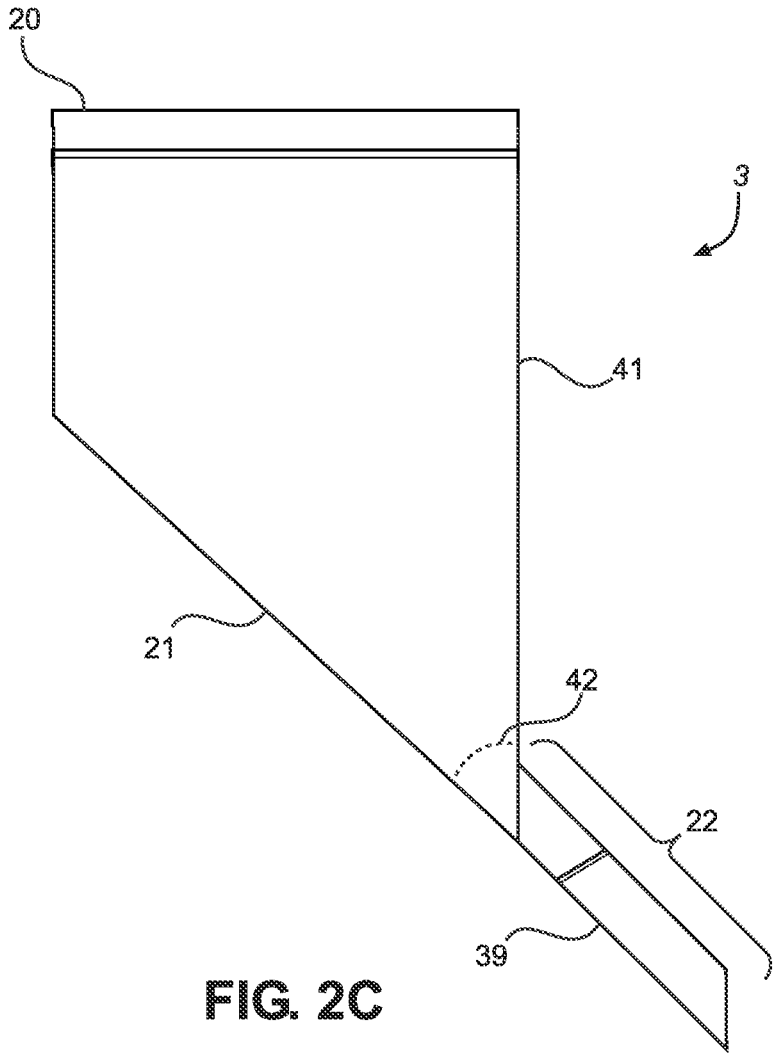
FIG. 2C depicts a side view of the fuel system, assembled.

Referring now to FIGS. 2A, 2B, and 2C, there are depicted views of a fuel system in a disassembled state (FIG. 2A) and in an assembled state (FIGS. 2B, and 2C). The fuel system 3 is comprised of the hopper 20 and the chute 22. The hopper 20 can include a funnel structure or other types of downward sloped angles therein to direct fuel, such as wood pellets, downward by force of gravity toward hopper opening 37 and into chute 22. Chute 22 can be comprised of chute upper member 35 and chute lower member 36 which can be secured together to form the chute 22. The chute upper member 35 can directly engage the hopper opening 37 and the chute lower member 36 can engage the chute upper member 35 and extend beyond the hopper opening 37 along the hopper bottom 21 at a downward angle. Preferably, a chute lower member bottom 39 is parallel, or substantially so, with the hopper bottom 21. The chute lower member 36 can comprise aeration apertures 38 configured to allow combustion to occur at the point of exit from the chute 22 due to increased air flow to the fuel at the site of combustion. An angle 42 between the hopper bottom 21 and a hopper vertical reference 41 is acute, and preferably in a range of 35-55 degrees, such as 45 degrees, or substantially so. According to preferred embodiments, when the hopper vertical reference 41 is parallel, or substantially so, to the direction of the force of gravity (e.g., perpendicular to the ground or the base 10), then the fuel system 3 can steadily supply fuel, particularly wood pellets, from the hopper 20 through the chute 22 such that a rate of delivery of fuel to the combustion chamber can be about constant during use. According to preferred embodiments, no gate is utilized on the chute or fuel supply to control the downward flow of fuel into the combustion chamber.

Figure 3:
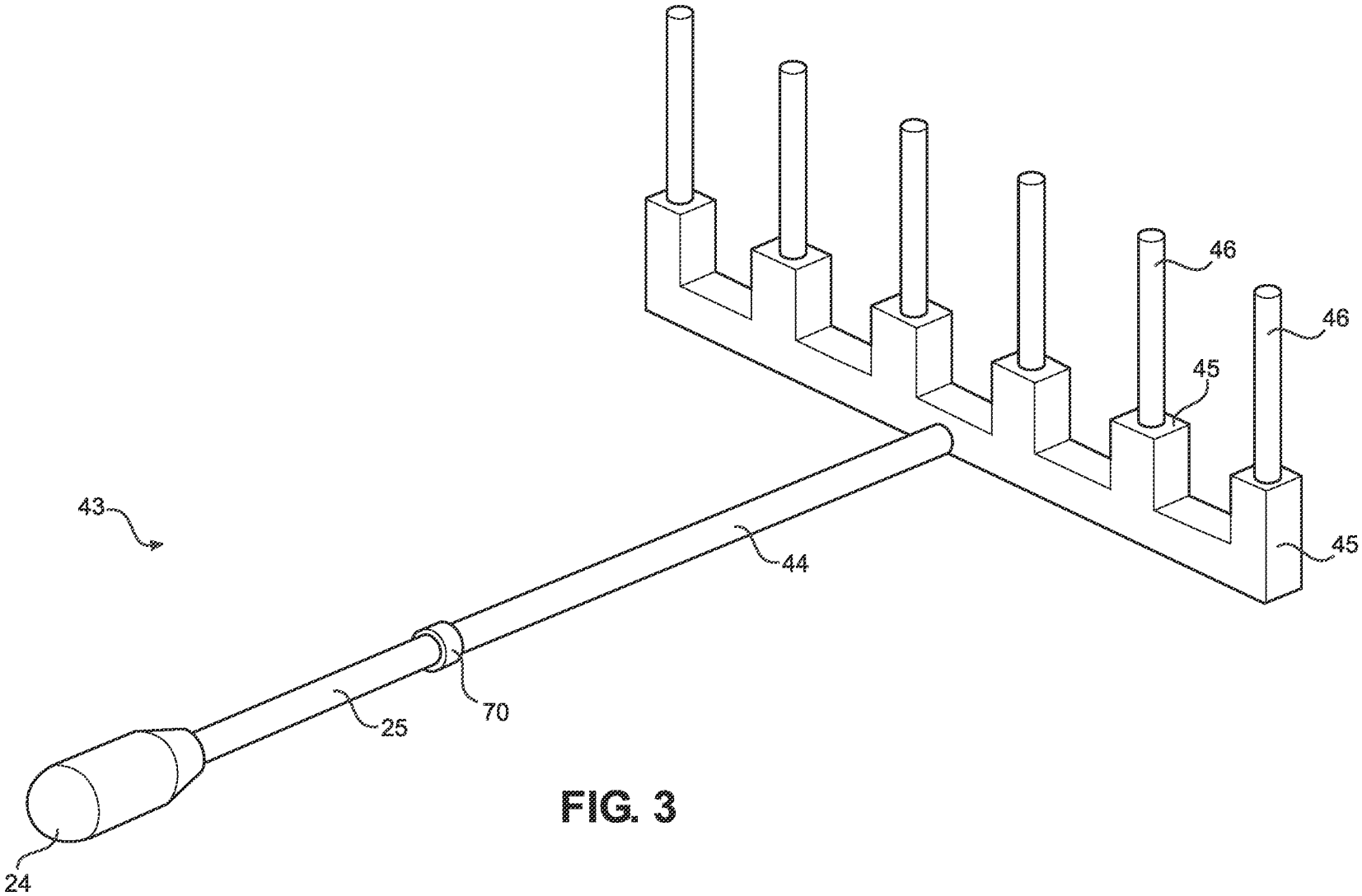
FIG. 3 depicts a perspective view of a sweep.

Referring now to FIG. 3, there is depicted a perspective view of a sweep 43. Preferably, a sweep 43 is comprised of a handle 24 a rod 25, and a rod extension 44 with a plurality of brushes 46 that extend upward therefrom. According to advantageous embodiments, a collar stop 70, positioned between the rod 25 and the rod extension 44, can be used to stop the distal motion of the sweep 43 within the firepot, as opposed to letting the brushes hit the distal wall of the firepot. According to preferred, non-exclusive embodiments, the brushes extend from a plurality of blocks 45, but can extend from merely a crossbar, or other suitable support members as well. Vertical lengths of the blocks 45 and brushes 46 can be defined such that the brushes 46 extend upward to reach gaps between bars of a firepot and in this manner the brushes 46 can remove solid combustion byproducts from the bars, which can fall into the ash tray. The brushes 46 are preferably made of a resilient material such as metal, including stainless steel, that is resistant to high temperatures and can clean metals. The brushes 46 can be individually manufactured as one-piece or can individually comprise multiple wires and/or bristles.

Figure 4:
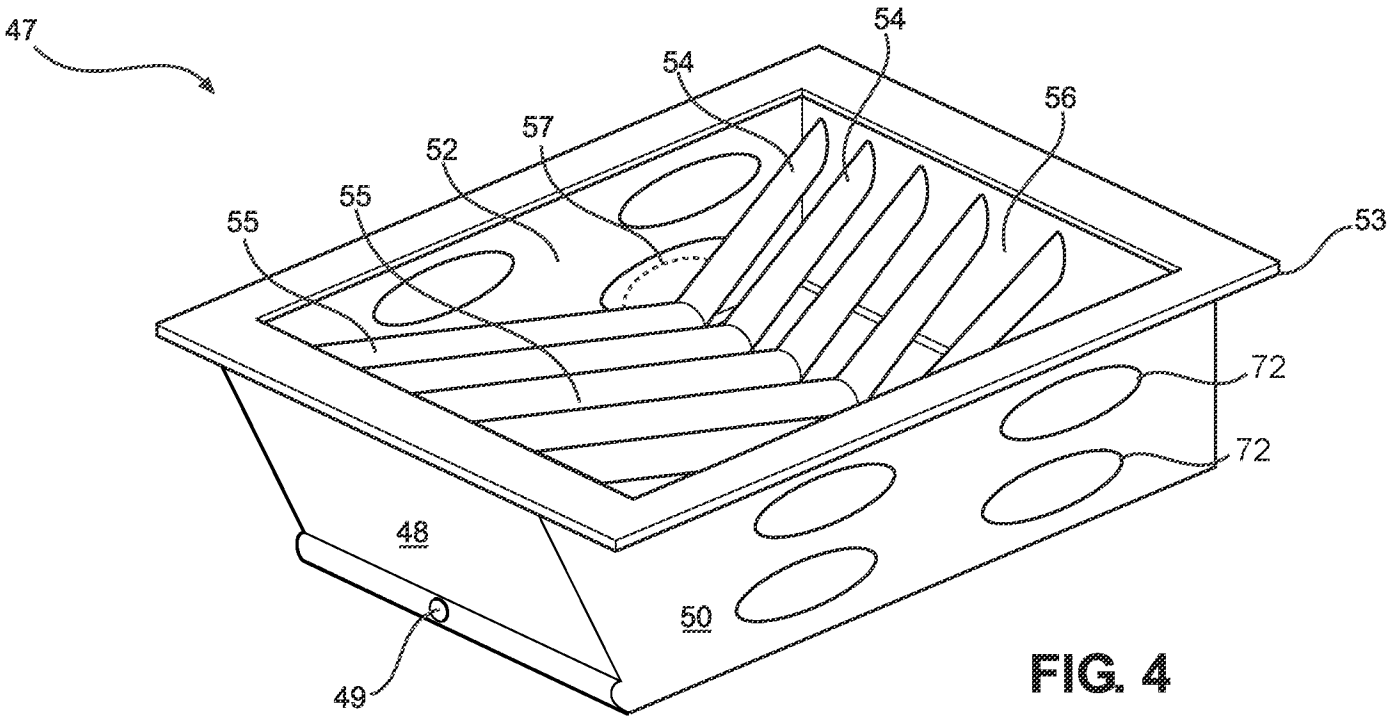
FIG. 4 depicts a perspective view of a firepot.

Referring now to FIG. 4, there is depicted a perspective view of a firepot without a sweep. A firepot 47 can comprise a housing comprised of a back wall 48, a right wall 50, a front wall 56, and a left wall 52 which together form an interior of the firepot 47 that comprises a plurality of bars (54, 55) that extend from the back wall 48 to the front wall 56. The bars (54, 55) can be comprised of a suitable alloy, such as cold-rolled steel (e.g., 309 stainless steel, 310 stainless steel, and the like), which when heated to high temperatures results in solid combustion byproducts being repelled from the bars (54, 55) and disposed below the firepot 47 without assistance from the sweep. However, in certain implementations, the bars (54, 55) can be comprised of a different material or can benefit from the sweep for removal of solid combustion byproducts, and in such instances the sweep can be disposed within the firepot 47 during assembly as shown in FIGS. 5A, and 5B.

Figure 9:
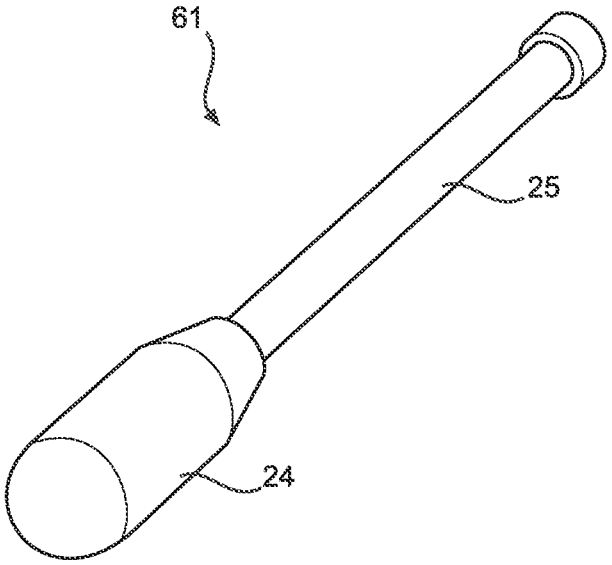
FIG. 9 depicts a perspective view of a handle member.

Referring again to FIG. 4, the firepot 47 might not have a substantial bottom portion and can include a bottom opening instead to ensure that solid combustion byproducts are able to fall therefrom without hindrance. Bars (54, 55) of the plurality of bars can be angled to form proximal bar portions 55 and distal bar portions 54 connected at a bar angle 57, such that the bar angle 57 configures the proximal bar portions 55 to allow the fuel to slide thereon and configures the distal bar portions 54 to engage the fuel to form a fuel pile for combustion. The firepot 47 can comprise a handle attachment site 49 at which a handle member (e.g., a handle member 61 of FIG. 9 having a handle 24 and a rod 25) can be affixed such that the firepot 47 can be adjusted. If the handle member is affixed to a wedge, then the wedge can be moved horizontally to slide the wedge in and out from under a ridge 53 of the firepot 47 to vertically move a portion of the firepot 47 to adjust the distance between the firepot 47 and the fuel system which can be secured at a desired position with a securement mechanism. The ridge 53 can extend around a perimeter of the firepot 47 and can rest upon a platform disposed within the combustion chamber to define a maximum distance between the firepot 47 and the fuel system. The firepot 47 can comprise a plurality of firepot apertures 72 thereon to facilitate air flow and increase combustion efficiency.

Figure 5A:
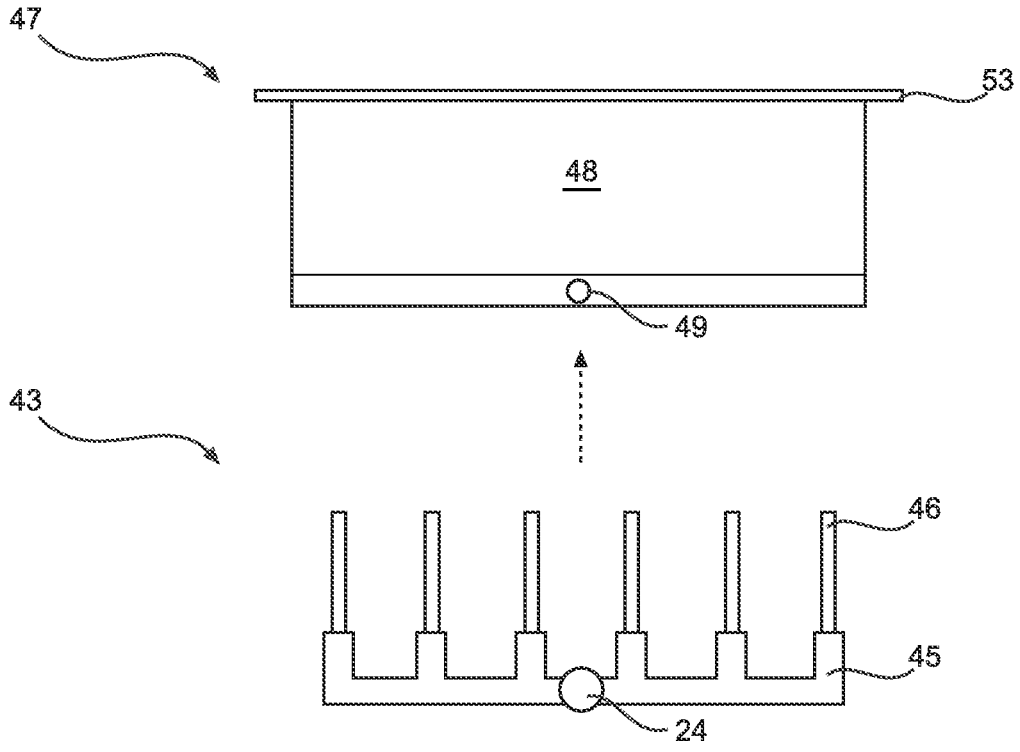
FIG. 5A depicts a side view of the sweep and the firepot during assembly of a firepot assembly that includes the sweep and the firepot.
Figure 5B:
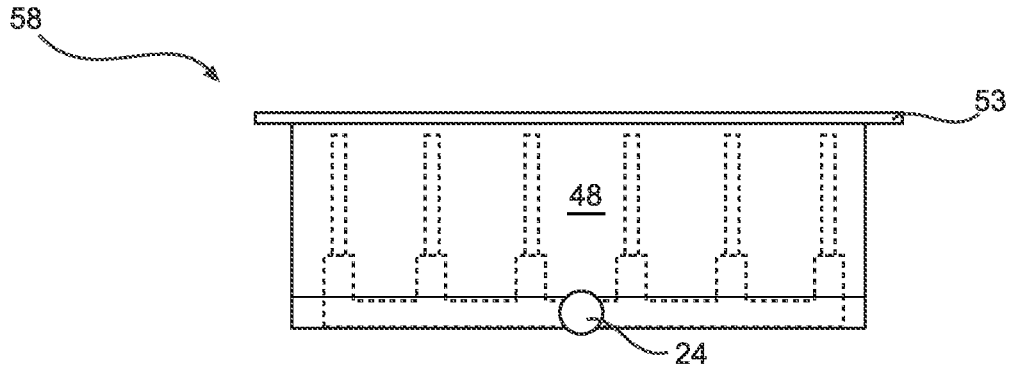
FIG. 5B depicts a side view of the sweep and the firepot after assembly of the firepot assembly that includes the sweep and the firepot.

Referring now to FIGS. 5A, and 5B, there are depicted views of a firepot assembly that includes the sweep and the firepot during (FIG. 5A) and after (FIG. 5B) assembly. The firepot 47 can be made by an assembly process which comprises at least one intermediate step at which the interior of the firepot 47 is accessible to position the sweep 43 therein. After the sweep 43 is positioned within the firepot 47, other portions of the firepot 47 can be attached to assemble a firepot assembly 58.

Figure 6A:
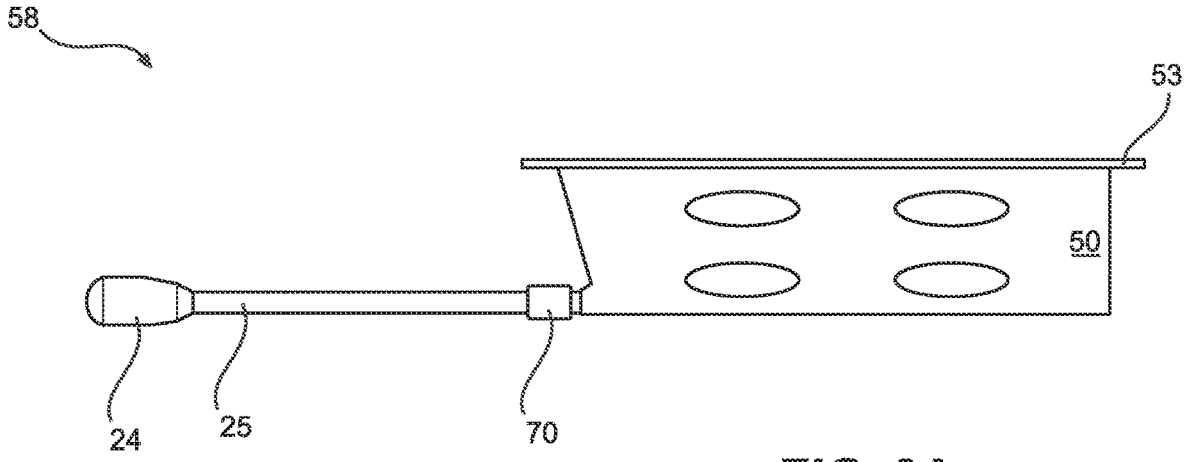
FIG. 6A depicts a side view of a firepot assembly with a sweep in a first position.
Figure 6B:
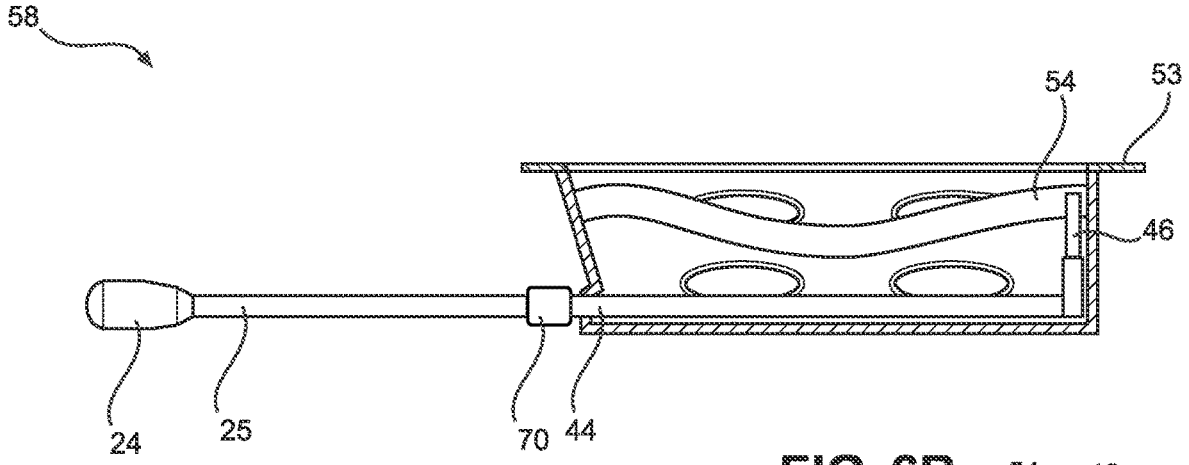
FIG. 6B depicts a side cutaway view of the firepot assembly with the sweep in the first position.
Figure 6C:
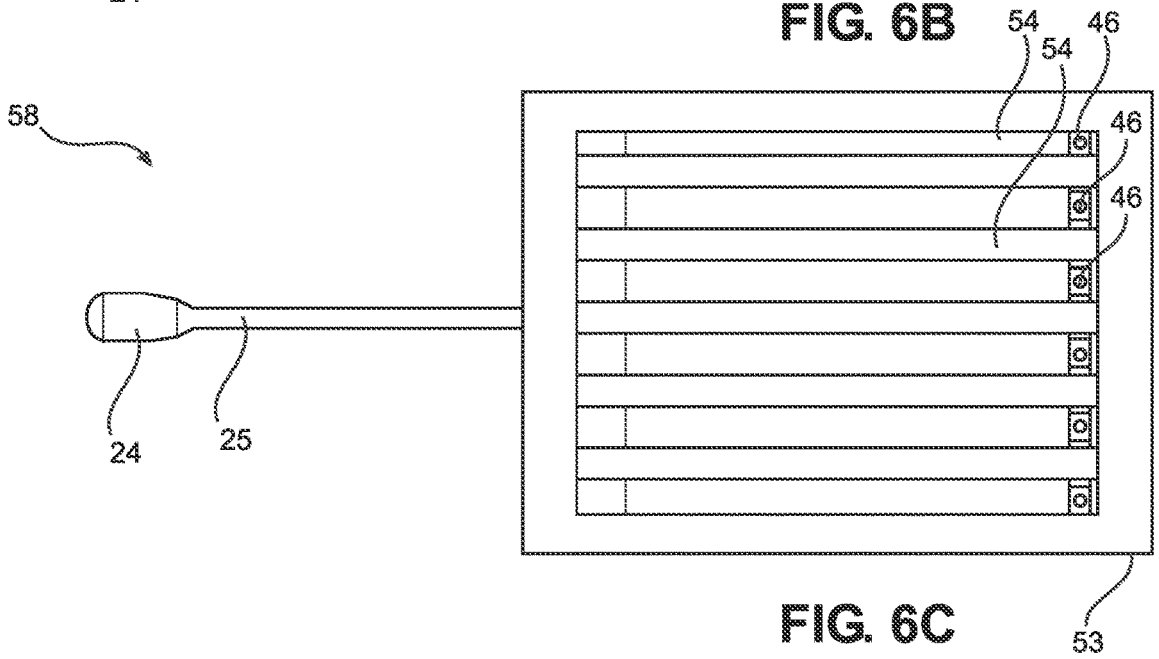
FIG. 6C depicts a top view of the firepot assembly with the sweep in the first position.
Figure 7A:
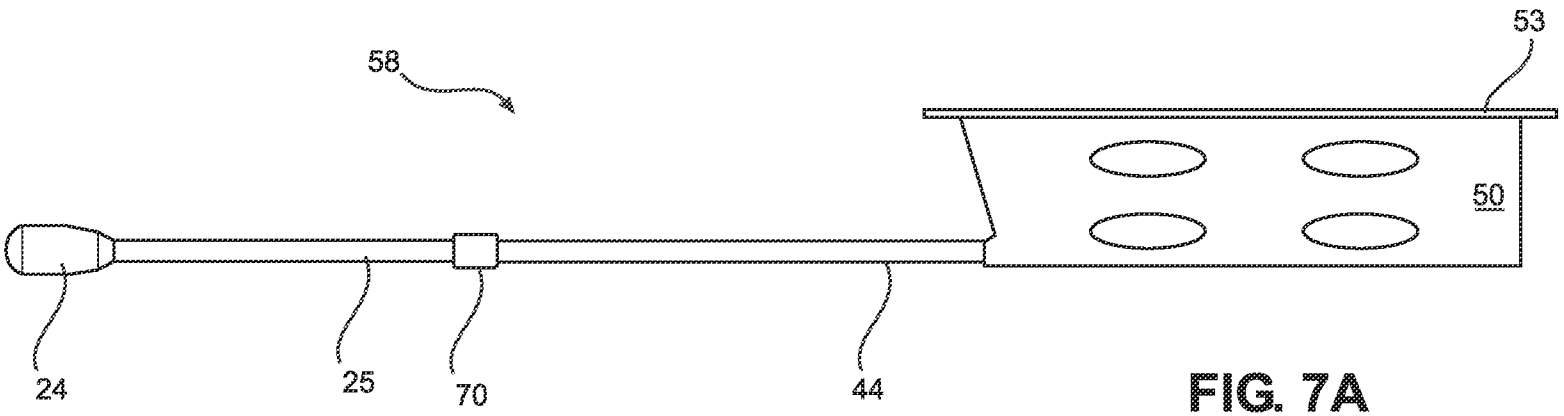
FIG. 7A depicts a side view of the firepot assembly with the sweep in a second position.
Figure 7B:
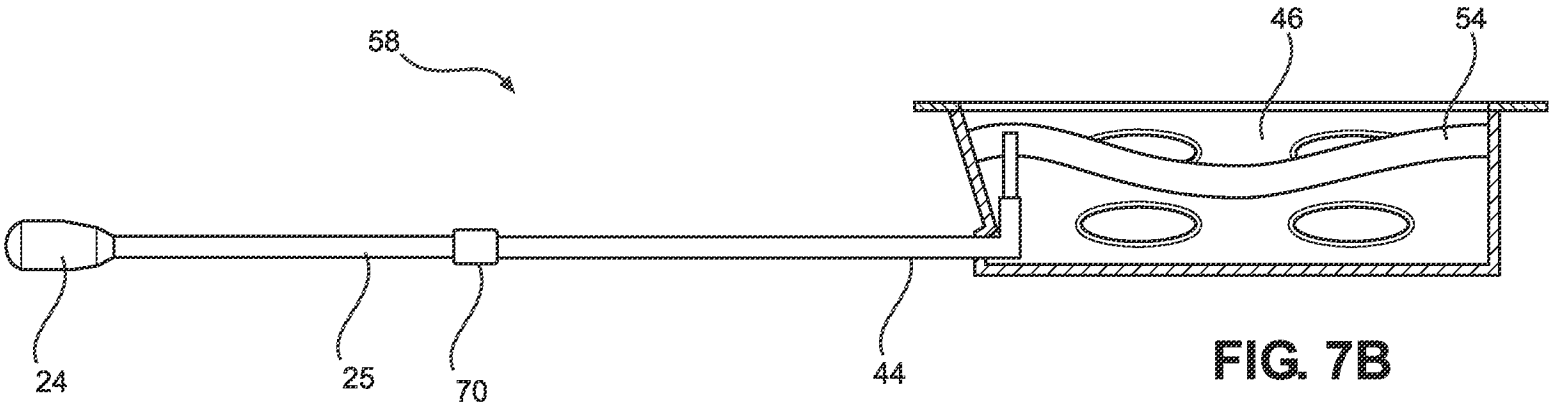
FIG. 7B depicts a side cutaway view of the firepot assembly with the sweep in the second position.
Figure 7C:
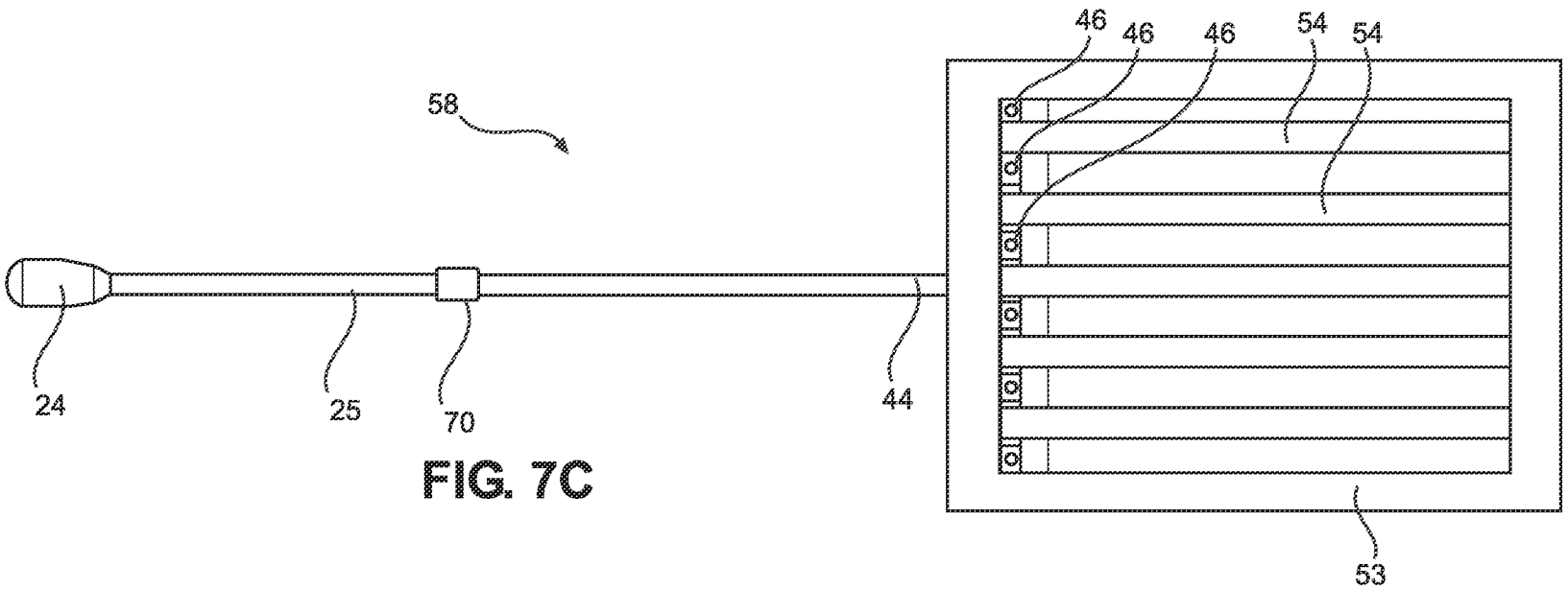
FIG. 7C depicts a top view of the firepot assembly with the sweep in the second position.

Referring now to FIGS. 6A, 6B, and 6C, there are depicted views of a firepot assembly with a sweep in a first position and referring to FIGS. 7A, 7B, and 7C, there are depicted views of the firepot assembly with the sweep in a second position. The sweep can be controlled by an individual pushing and pulling the handle 24 to cause the rod 25 to move the rod extension 44 in and out of the firepot assembly thereby moving the brushes 46 connected thereto. The firepot assembly is shown with the right wall 50 present (FIG. 6A) and with the right wall 50 removed (FIG. 6B) to illustrate operation of the brushes 46 to clean the bars 54. The brushes 46 can be slidably disposed between bars 54, such that a slide movement of the sweep (e.g., from the first position to the second position) moves brushes 46 to dislodge solid combustion byproducts which then pass through the bottom opening of the firepot assembly 58 and fall away from the site of combustion toward the ash tray.

Figure 8A:
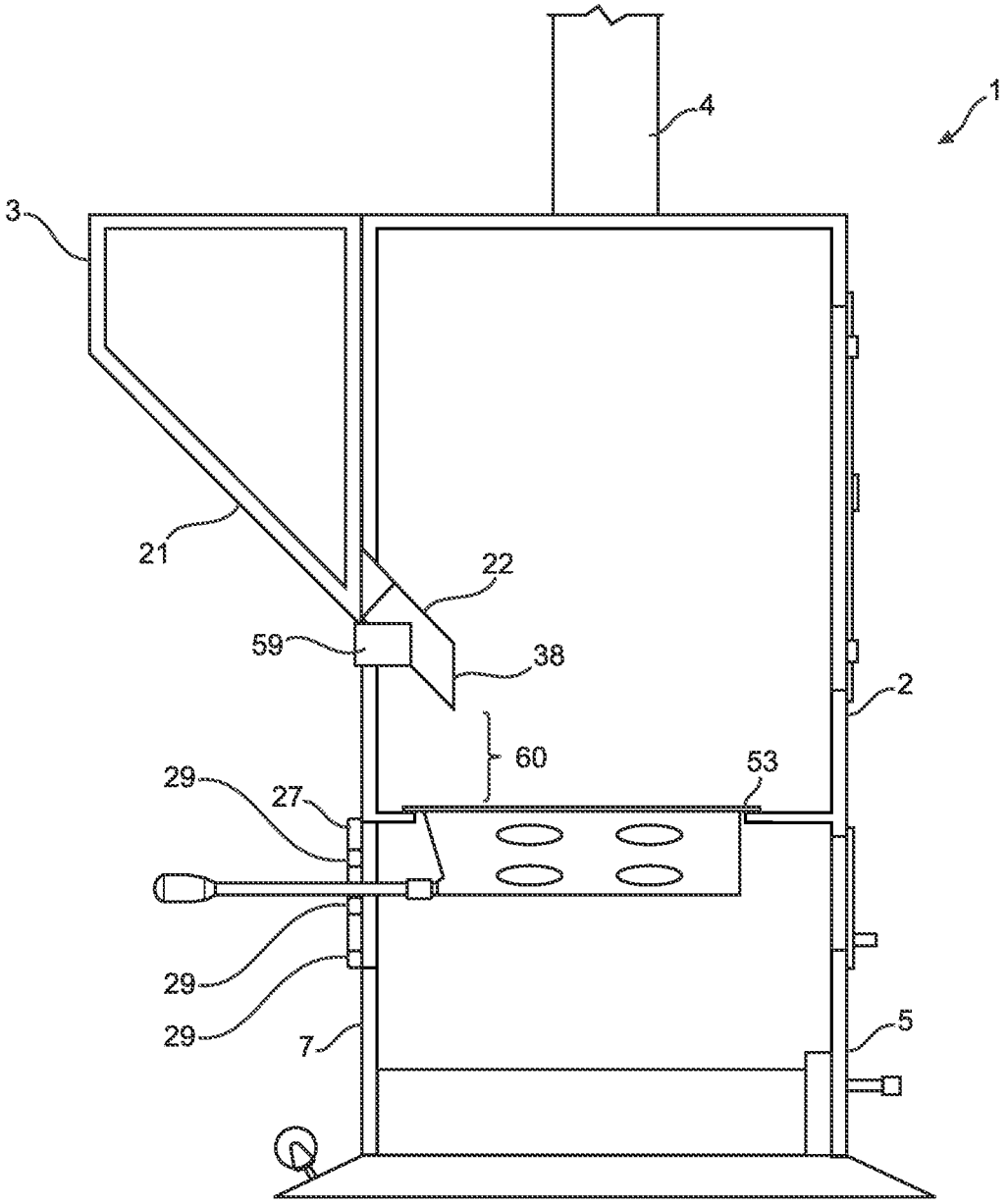
FIG. 8A depicts a side cutaway view of a stove device with a firepot assembly in a first position before a vertical adjustment.
Figure 8B:
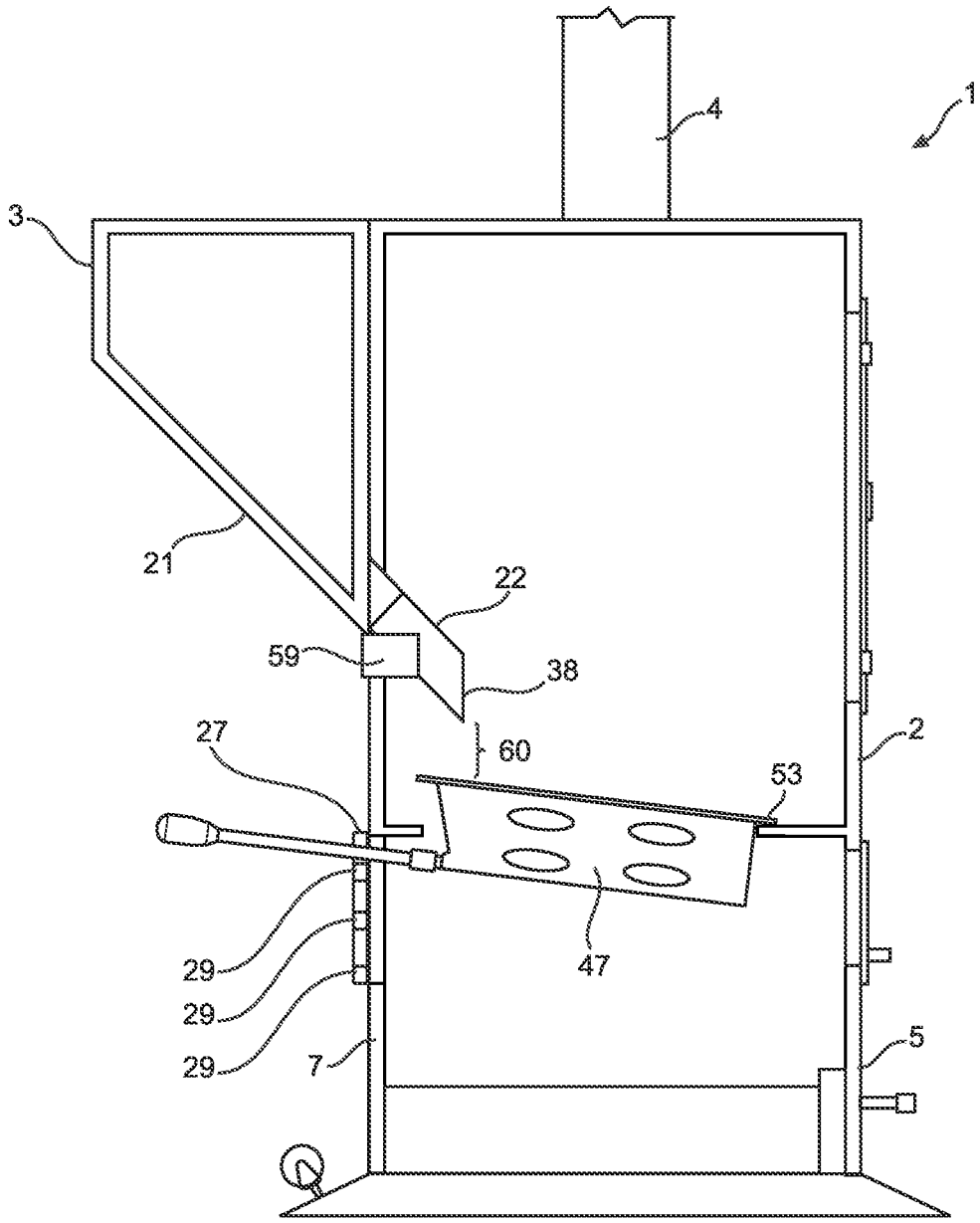
FIG. 8B depicts a side cutaway view of the stove device with the firepot assembly in a second position after the vertical adjustment.

Referring now to FIGS. 8A, and 8B, there are depicted a stove device with a firepot assembly in a first (lower) position before a vertical adjustment (FIG. 8A) and in a second (higher) position after the vertical adjustment (FIG. 8B). In implementations of the stove device 1, the chute 22 can be secured to the housing 2 with a chute collar 59 that extends from the back wall toward the front wall 5 and is configured to hold the chute 22 in place. A distance 60 between the firepot assembly and the aeration apertures 38 of the chute 22 of the fuel system 3 can be adjustable by raising and lowering the firepot assembly or a portion of the firepot assembly. The desired position of the firepot assembly can be secured in at any of a plurality of vertical positions with any member 29 of securement member 27.

As fuel, such as wood pellets, tumbles down the hopper bottom 21 and through the chute 22, it accumulates as a fuel pile within the firepot assembly and is ignited by an individual to start combustion or is continually burned as part of ongoing (i.e., previously ignited) combustion, and gaseous combustion byproducts exit the combustion chamber through the exhaust system 4. As the fuel burns the fuel pile becomes smaller and there becomes room for more fuel to enter the firepot assembly from the chute 22. The maximum amount of fuel in the fuel pile can be determined by the distance 60. If the distance 60 increases, then more fuel can fall into the fuel pile to increase the heat output from combustion. If the distance 60 decreases, then less fuel can fall into the fuel pile and the heat output from combustion decreases. The portion of the firepot assembly that is raised and lowered can be selected such that such raising and lowering impacts the volume of the fuel pile, for example, the portion raised and lowered can include a portion of the firepot assembly that is proximal to the fuel system 3 and the chute 22.

Figure 10A:
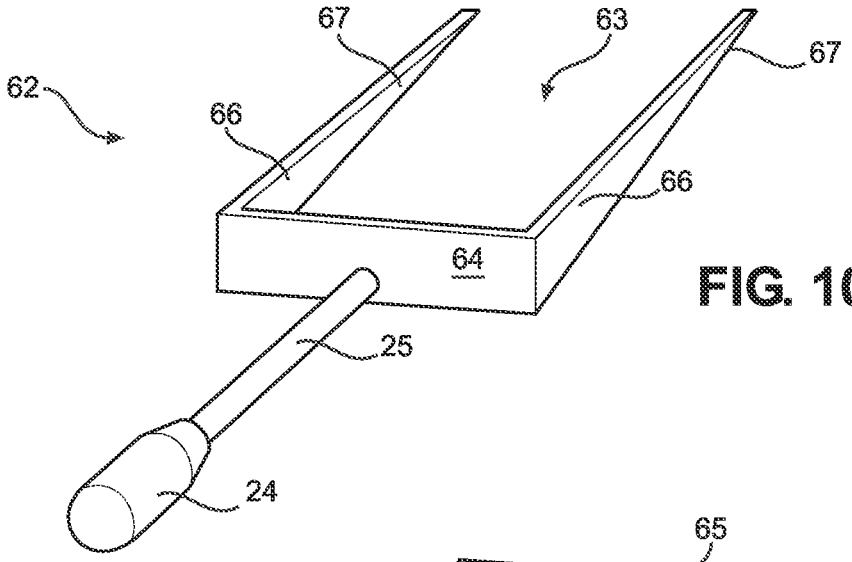
FIG. 10A depicts a perspective view of a first wedge.
Figure 10B:
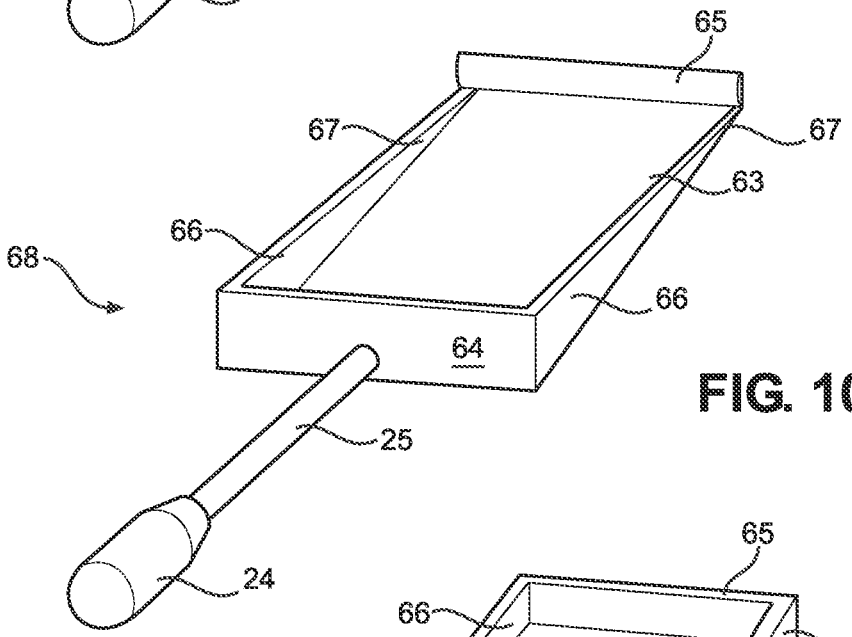
FIG. 10B depicts a perspective view of a second wedge.
Figure 10C:
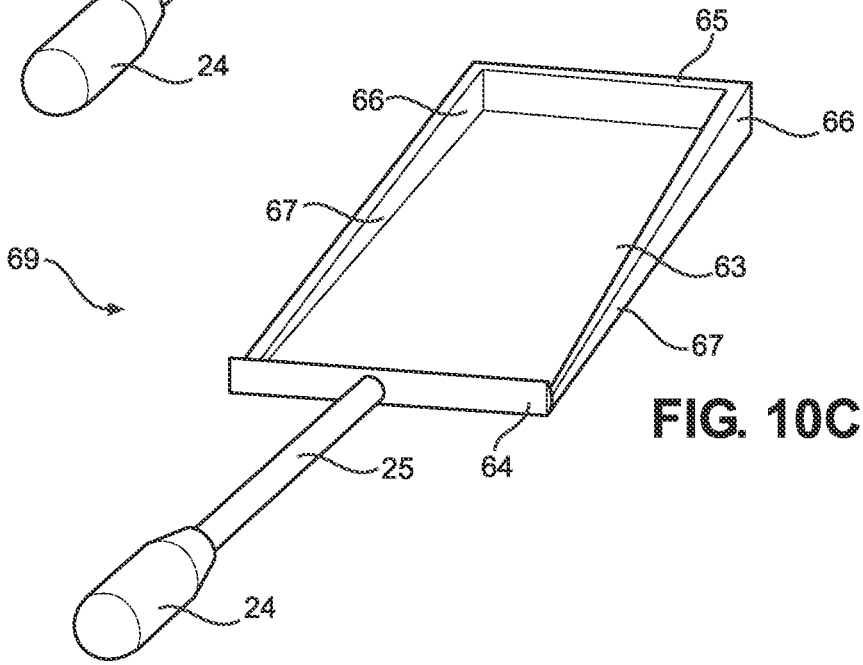
FIG. 10C depicts a perspective view of a third wedge.

Referring now to FIGS. 10A, 10B, and 10C, there are depicted perspective views of different implementations of a wedge including a first wedge (FIG. 10A), a second wedge (FIG. 10B), and a third wedge (FIG. 10C). A wedge 62 comprises a handle member having a handle 24 and a rod 25 that is affixed to a wedge member that forms a gap 63 between portions of the wedge member. The wedge member can be comprised of at least a back wall 64 affixed to a pair of opposing wedge forks 67. The wedge forks 67 are generally longer in length than the length of the firepot such that when the wedge forks 67 can slide in and out from under the ridge of the firepot as part of a horizontal adjustment to raise or lower the firepot or a portion thereof. The wedge forks 67 can include elevated portions 66 on proximal portions thereof (FIG. 10A, FIG. 10B) or on distal portions thereof (FIG. 10C). If the elevated portions 66 are proximal to the handle 24, then a front wall 65, which can abut against the firepot when the firepot is maximally lowered with the wedge 62, can either be included (e.g., wedge 68 of FIG. 10B) or omitted (e.g., wedge 62 of FIG. 10A). If the elevated portions 66 are distal to the handle 24, then the front wall 65 can engage the elevated portions 66 (e.g., wedge 69 of FIG. 10C). The first and second wedges (62, 68) can be configured for use with a stove device with a handle aperture on a back wall of the stove device (such that the elevated portions 66 are proximal to a fuel system), and the third wedge (69) can be configured for use with a stove device with a handle aperture on a front wall of the stove device (such that the elevated portions 66 are proximal to a fuel system).

Figure 11B:
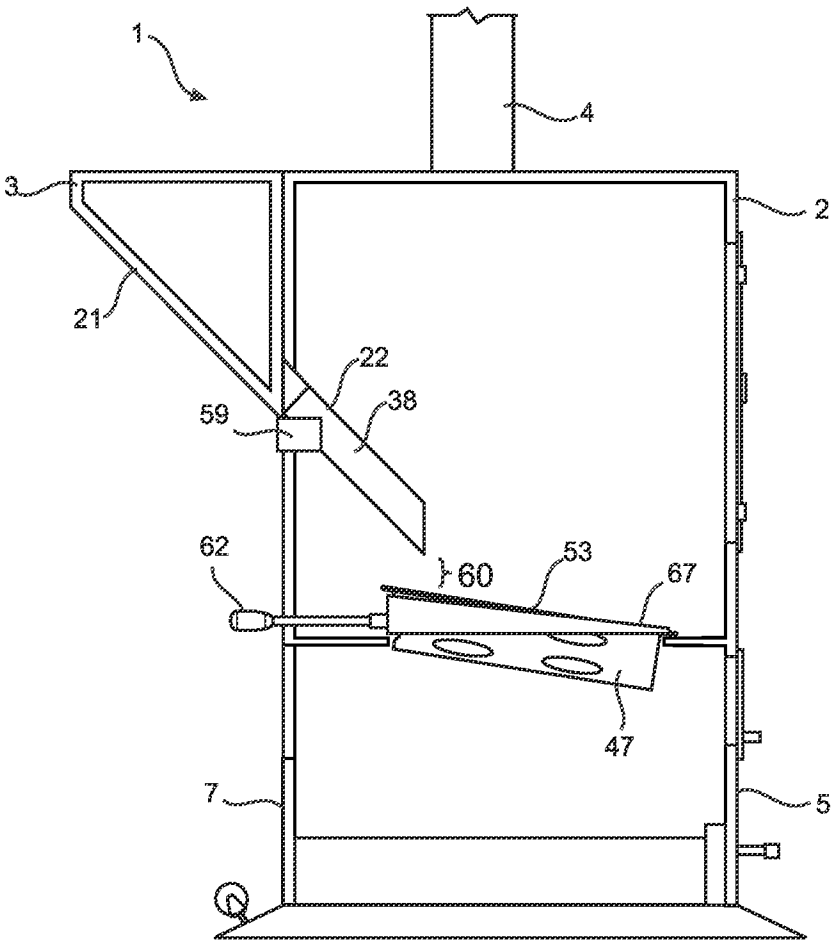
FIG. 11B depicts a side cutaway view of the stove device with the firepot assembly in a second position after the horizontal adjustment.
Figure 11A:
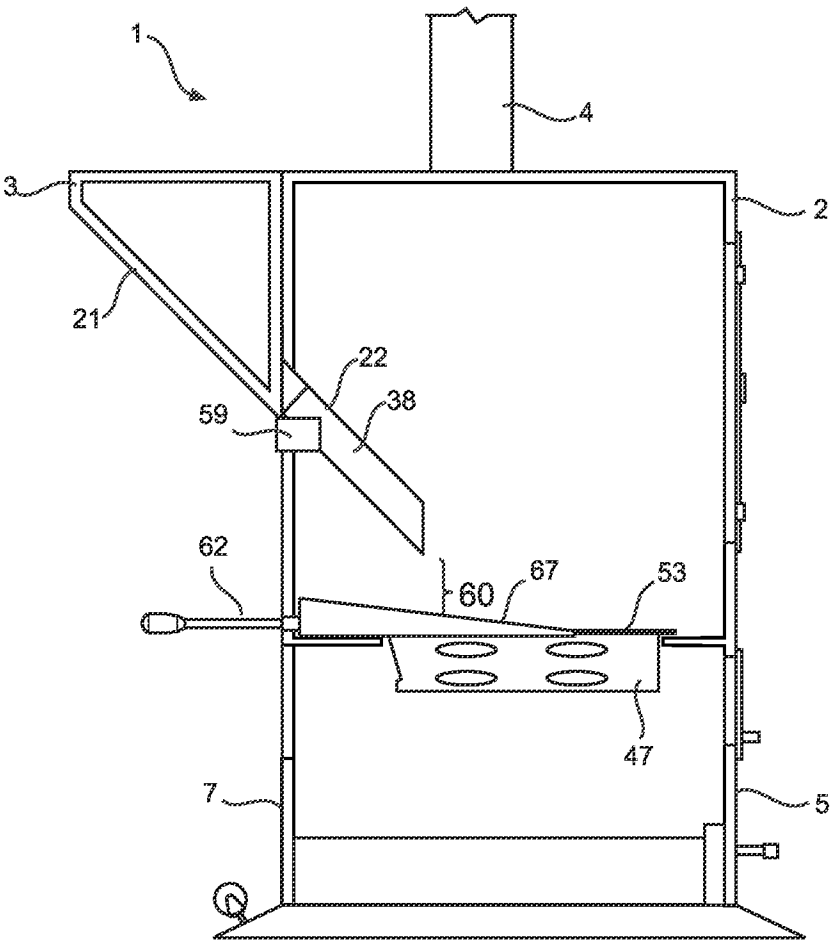
FIG. 11A depicts a side cutaway view of a stove device with a firepot assembly in a first position before a horizontal adjustment.

Referring now to FIGS. 11A, and 11B, there are depicted a stove device with a firepot assembly in a first (lower) position before a horizontal adjustment (FIG. 11A) and in a second (higher) position after the horizontal adjustment (FIG. 11B). As described elsewhere herein, the stove device 1 can include the fuel system 3 secured in place by the chute collar 59 to deliver fuel from the fuel system 3 to the firepot 47 for combustion, which produces gaseous combustion byproducts that exit through the exhaust system 4. A wedge 62 (e.g., the first wedge as depicted in FIG. 10A) can be moved horizontally (e.g., from the first, proximal position to the second, distal position) to slide the wedge 62 in and out from under the ridge of the firepot 47 to vertically move a portion of the firepot 47 to adjust the distance 60 between the firepot 47 and the fuel system (3, 21, 22, 38) which can be secured at a desired position with a securement mechanism such as friction between the wedge 62 and an adjacent structure, such as the platform (e.g., the platform that extends from the walls including the back wall 7 and the front wall 5), upon which the ridge of the firepot 47 at least partially rests in the first position. In implementations, most or all portions of the wedge 62, other than portions of the handle used to grip and adjust the wedge 62, can be substantially positioned within the housing 2 of the stove device 1 regardless of position of the firepot 47. According to preferred embodiments, the slope of the wedge 62 from the elevated portions 66 to the forks 67 allows for gradual or continuous adjustment of the distance between the firepot and the fuel system as opposed to incremental adjustment as shown in FIGS. 8A and 8B.

According to further non-preferred and non-illustrated embodiments, the chute can be lengthened and shortened in addition or instead of raising and lowering the firepot, to respectively decrease and increase the distance between the fuel system and the firepot and thereby lower and raise the combustion temperature.

The foregoing descriptions of specific implementations have been presented for purposes of illustration and description. They are not intended to be exhaustive or to limit the invention to the precise forms disclosed, and modifications and variations are possible in view of the above teaching. The exemplary implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical and exemplary implementations. It should be recognized that departures can be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

I claim:

1. A stove device for outdoor heating, comprising:

a housing comprising a combustion chamber;

a firepot assembly positioned inside the combustion chamber, wherein the firepot assembly is configured for combustion of a fuel thereon; and a fuel system configured to store the fuel and deliver the fuel to the firepot assembly for combustion;

wherein a distance between the firepot assembly and the fuel system is adjustable to control temperature of combustion, such that when the distance between the firepot assembly and the fuel system is increased, a volume of a fuel pile in the firepot assembly and temperature of combustion is increased, and when the distance between the firepot assembly and the fuel system is decreased, the volume of the fuel pile in the firepot assembly and temperature of combustion is decreased.

2. The stove device of claim 1, wherein an air flow from an exterior of the stove device to a combustion reaction in the combustion chamber is controllable by an air flow vent disposed on the housing.

3. The stove device of claim 1, wherein the firepot assembly comprises a plurality of bars coupled to the firepot and configured to hold the fuel thereon and to allow a solid combustion byproduct from the fuel to pass therethrough.

4. The stove device of claim 3, wherein bars of the plurality of bars are angled to form proximal bar portions and distal bar portions connected at a bar angle, wherein the bar angle configures the proximal bar portions to allow the fuel to slide thereon and configures the distal bar portions to engage the fuel to form a fuel pile for combustion.

5. The stove device of claim 1, wherein the fuel system comprises a hopper configured to hold the fuel and to release the fuel via gravity into a chute of the fuel system for delivery of the fuel to the firepot assembly.

6. The stove device of claim 5, wherein the fuel is gravity fed at a chute angle of between 35-55 degrees.

7. The stove device of claim 1, wherein the distance is adjustable by raising and lowering the firepot assembly or a portion of the firepot assembly.

8. The stove device of claim 7, wherein the portion of the firepot assembly is proximal to the fuel system.

9. The stove device of claim 1, wherein the firepot assembly comprises a handle that extends from the firepot assembly and out of the housing, and configured such that an adjustment of the handle adjusts the distance between the firepot assembly and the fuel system.

10. The stove device of claim 9, wherein the adjustment of the handle comprises a vertical adjustment or a horizontal adjustment.

11. The stove device of claim 10, wherein the handle extends from a portion of the firepot assembly that is proximal to the fuel system, and wherein the vertical adjustment is securable at any of a plurality of vertical positions.

12. The stove device of claim 10, wherein the handle extends from a portion of the firepot assembly that is proximal to the fuel system, and wherein the horizontal adjustment moves a wedge in either a proximal or distal direction with respect to the handle.

13. The stove device of claim 10, wherein the handle extends from a portion of the firepot assembly that is distal to the fuel system, and wherein the horizontal adjustment moves a wedge in either a proximal or distal direction with respect to the handle.

14. The stove device of claim 1, wherein the firepot assembly comprises a firepot comprising a plurality of bars configured to hold the fuel thereon, wherein bars of the plurality of bars are cleanable with a sweep of the firepot assembly to allow a solid combustion byproduct to pass therethrough.

15. The stove device of claim 14, wherein brushes of a plurality of brushes of the sweep are slidably disposed between bars of the plurality of bars of the firepot, wherein a slide movement of the sweep moves brushes of the plurality of brushes to allow the solid combustion byproduct to pass therethrough.

16. A method of controlling temperature in a stove device for outdoor heating, comprising:

providing the stove device, the stove device comprising:

a housing comprising a combustion chamber;

a firepot assembly positioned inside the combustion chamber, wherein the firepot assembly is configured for combustion of a fuel thereon; and a fuel system configured to store the fuel and deliver the fuel to the firepot assembly for combustion;

wherein a distance between the firepot assembly and the fuel system is adjustable to control temperature of combustion; and raising and lowering the firepot assembly and the fuel system to control temperature of combustion, such that when the distance between the firepot assembly and the fuel system is increased, a volume of a fuel pile in the firepot assembly and temperature of combustion is increased, and when the distance between the firepot assembly and the fuel system is decreased, the volume of the fuel pile in the firepot assembly and temperature of combustion is decreased.

17. The method of claim 16, wherein the fuel system comprises a hopper configured to hold the fuel and to release the fuel via gravity into a chute of the fuel system for delivery of the fuel to the firepot assembly.

18. The method of claim 16, wherein the firepot assembly comprises a firepot comprising a plurality of bars configured to hold the fuel thereon, wherein bars of the plurality of bars are cleanable with a sweep of the firepot assembly to allow a solid combustion byproduct to pass therethrough.

* * * * *